US006673238B2

(12) United States Patent
Gerhold et al.

(10) Patent No.: US 6,673,238 B2
(45) Date of Patent: Jan. 6, 2004

(54) ACIDIC PETROLEUM OIL TREATMENT

(75) Inventors: Bruce W. Gerhold, Bartlesville, OK (US); Joseph E. Bares, Bartlesville, OK (US); Scott D. Love, Bartlesville, OK (US); Jerry G. Feierabend, Bartlesville, OK (US)

(73) Assignee: ConocoPhillips Company, Houston, TX (US)

( * ) Notice: Subject to any disclaimer, the term of this patent is extended or adjusted under 35 U.S.C. 154(b) by 120 days.

(21) Appl. No.: 10/007,480

(22) Filed: Nov. 8, 2001

(65) Prior Publication Data

US 2003/0085157 A1 May 8, 2003

(51) Int. Cl.[7] ..... C10G 29/20; C10G 17/00; C10G 21/12

(52) U.S. Cl. ..... 208/263; 208/236; 208/282; 208/290

(58) Field of Search ..... 208/282, 236, 208/290, 263

(56) References Cited

U.S. PATENT DOCUMENTS

| | | | | |
|---|---|---|---|---|
| 4,293,404 A | * | 10/1981 | Farcasiu et al. | 208/214 |
| 5,182,013 A | * | 1/1993 | Petersen et al. | 208/348 |
| 5,910,242 A | * | 6/1999 | Halbert et al. | 208/263 |
| 6,054,042 A | * | 4/2000 | Gorbaty et al. | 208/263 |
| 6,464,859 B1 | * | 10/2002 | Duncum et al. | 208/263 |

* cited by examiner

*Primary Examiner*—Walter D. Griffin
*Assistant Examiner*—Tam M. Nguyen
(74) *Attorney, Agent, or Firm*—Kameron D. Kelly

(57) ABSTRACT

A process for hydrotreating acidic compounds of an acidic petroleum oil is disclosed. The process includes contacting the acidic petroleum oil with a hydrogen donor solvent to thereby produce a treated petroleum oil. The process can further include contacting a fraction or a full-boiling range portion of the treated petroleum oil with a hydrogenation catalyst in the presence of hydrogen and under process conditions sufficient to hydrogenate at least a portion of the hydrocarbons of the fraction or full-boiling range portion; and utilizing at least a portion of the hydrogenated fraction or full-boiling range portion as the hydrogen donor solvent.

33 Claims, 2 Drawing Sheets

ACIDIC PETROLEUM OIL TREATMENT

The present invention relates to a method for the treatment of acidic petroleum oils, such as acidic crude oils. More specifically, the invention relates to a method for reducing the acidity of acidic petroleum oils.

BACKGROUND OF THE INVENTION

The problems acidic petroleum oils, and in particular acidic crude oils, cause in production and/or refining operations is well known in the art. Such problems include corrosion of refining and/or production units, piping and equipment. Thus, many refiners refuse to purchase high acid crude oils or they purchase them only at significant price discounts.

The standard method used to treat acidic petroleum oils includes catalytic hydrotreating of the acidic petroleum oil to treat the acids. However, operationally, the acidic petroleum oil must be "cleaned" (desalted) prior to contact with the hydrotreating catalyst bed to avoid salt deactivation of the catalyst. The problems become circular because salt removal depends on water separation efficiency which is inhibited by the presence of acids or other polar species in the acidic petroleum oil. Thus, a producer or refiner cannot readily remove acids from the acidic petroleum oil by hydrotreating without first cleaning the acidic petroleum oil, but the acidic petroleum oil cleaning is impeded by the presence of acids.

Therefore, development of an efficient process for reducing the acidity of acidic petroleum oils would be a significant contribution to the art and to the economy.

BRIEF SUMMARY OF THE INVENTION

It is, thus, an object of the present invention to provide an improved process for reducing the acidity of an acidic petroleum oil.

Another object of the present invention is to provide an improved process for hydrotreating/hydrogenating an acidic petroleum oil.

A further object of the present invention is to provide an improved process for hydrotreating/hydrogenating an acidic petroleum oil using a hydrogen donor process.

According to a first embodiment of the present invention, a process for hydrotreating acidic compounds of an acidic petroleum oil is provided and comprises contacting an acidic petroleum oil comprising at least one acidic compound with a hydrogen donor solvent at process conditions sufficient to promote hydrogen transfer from the hydrogen donor solvent to the at least one acidic compound of the acidic petroleum oil, thereby producing a treated petroleum oil.

According to a second embodiment of the present invention, the inventive process of the first embodiment can further comprise the steps of:

removing a fraction from the treated petroleum oil;

contacting the fraction with a hydrogenation catalyst in the presence of hydrogen and under process conditions sufficient to hydrogenate at least a portion of the hydrocarbons of the fraction; and utilizing at least a portion of the fraction as the hydrogen donor solvent.

According to a third embodiment of the present invention, the inventive process of the first embodiment can further comprise the steps of:

contacting a portion of the treated petroleum oil with a hydrogenation catalyst in the presence of hydrogen and under process conditions sufficient to hydrogenate at least a portion of the hydrocarbons of the portion of the treated petroleum oil; and utilizing at least a portion of the portion of the treated petroleum oil as the hydrogen donor solvent.

Other objects and advantages will become apparent from the detailed description and the appended claims.

DETAILED DESCRIPTION OF THE INVENTION

The acidic petroleum oil suitable for use in the present invention can be any petroleum oil containing acidic components. Examples of acidic petroleum oil include, but are not limited to, synthetic liquids derived from coal or tar sands, and acidic crude oils, or fractions thereof, such as vacuum gas oil, atmospheric gas oil, distillate fractions, naphthas, and coker gas oil.

The acidic petroleum oil typically comprises at least one acidic compound. The acidic compounds can be any compounds having acidic characteristics, such as a pH below 7.0, however slight. The acidic compounds typically comprise, consist of, or consist essentially of naphthenic acids. The naphthenic acids are typically carboxylic acids of the formula R—COOH, wherein R comprises in the range of from 1 to 50 carbon atoms, more typically from 5 to 35 carbon atoms, and most typically from 9 to 25 carbon atoms per molecule. The R group can also contain heteroatoms such as oxygen, sulfur and nitrogen and can include additional —COOH groups.

The total acid number (TAN), as determined using ASTM test method D 644-95 (Test Method for Neutralization Number by Potentiometric Titration), of the acidic petroleum oil is typically in the range of from about 0.5 to about 10, more typically from about 1 to about 7, and most typically from 1 to 5.

Figure 1:
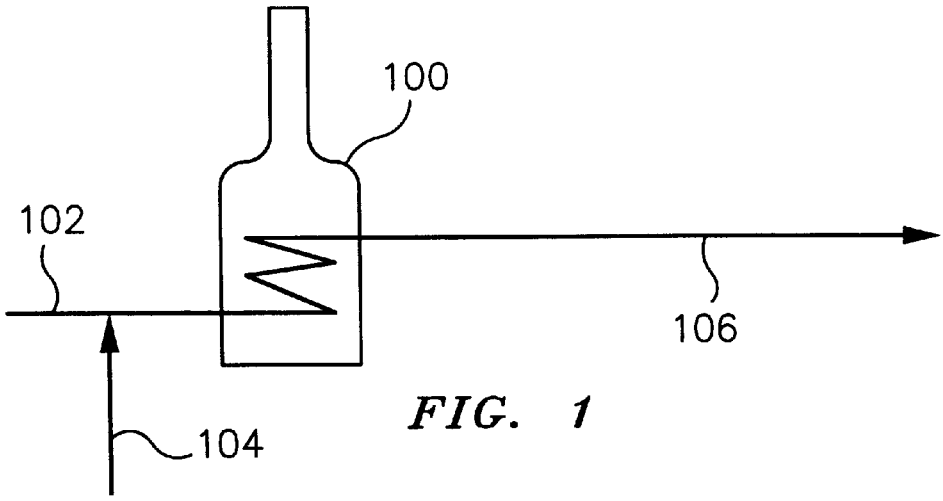
FIG. 1 is a schematic flow diagram presenting an embodiment of the present invention.

In accordance with a first embodiment of the present invention, and referring to FIG. 1, an acidic petroleum oil is passed to a heat exchanger 100 via conduit 102 for contact with a hydrogen donor solvent which is passed to heat exchanger 100 via conduit 104. Such contact takes place at process conditions sufficient to promote hydrogen transfer from the hydrogen donor solvent to the at least one acidic compound of the acidic petroleum oil, thereby producing a treated petroleum oil. The treated petroleum oil is removed from heat exchanger 100 via conduit 106 and has a TAN which is lower than the TAN of the acidic petroleum oil. Preferably, the TAN of the treated petroleum oil is less than 1.0, more preferably less than 0.7, even more preferably less than 0.5, and most preferably less than 0.1.

The hydrogen donor solvent useful in the present invention can be any solvent capable of transferring at least one hydrogen to another compound, such as an acidic compound, at suitable hydrogen transfer conditions. The hydrogen donor solvent preferably comprises, consists of, or consists essentially of, a hydrocarbon selected from the group consisting of decalin ($C_{10}H_{18}$), tetralin ($C_{10}H_{12}$), any petroleum oil having hydrogen added thereto, and combinations of any two or more thereof.

The acidic petroleum oil is preferably contacted with the hydrogen donor solvent without the presence of a hydrogenation catalyst.

Also, the acidic petroleum oil is preferably contacted with the hydrogen donor solvent prior to desalting of the acidic petroleum oil. The treatment of acidic compounds in the acidic petroleum oil leads to more efficient desalting.

The process conditions include a temperature sufficient to promote hydrogen transfer which is also preferably below the temperature at which significant coking of the acidic petroleum oil occurs. Significant coking is defined to be the point at which 0.1 wt. % of the acidic petroleum oil is converted to coke. The contacting temperature is preferably in the range of from about 700 to about 900° F., more preferably from about 750 to about 850° F., and most preferably from about 775 to about 825° F.

As an example, the acidic compound can be hydrogenated by a hydrogen donor solvent by the following reaction mechanism:

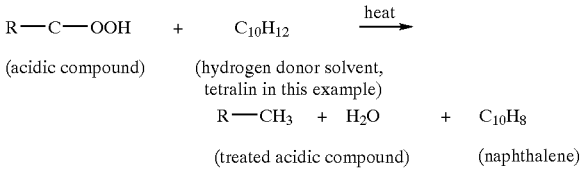

Figure 2:
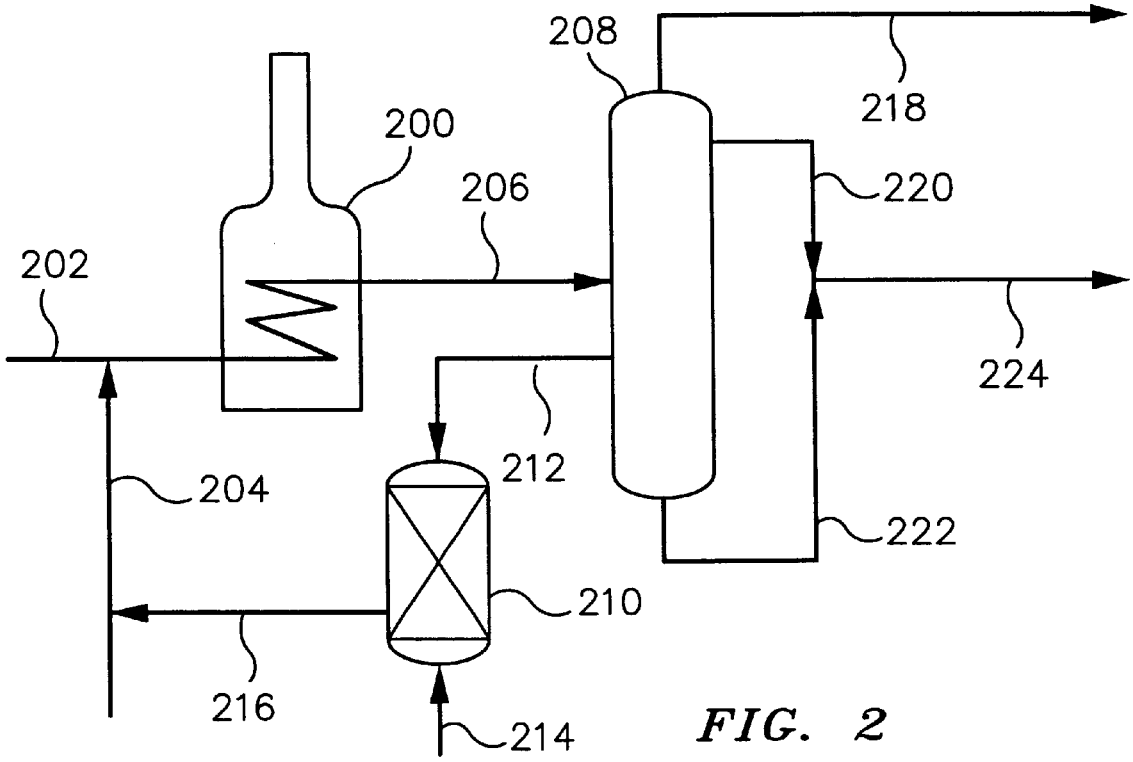
FIG. 2 is a schematic flow diagram presenting an embodiment of the present invention.

According to a second embodiment of the present invention, and referring to FIG. 2, an acidic petroleum oil, as described in the first embodiment, is passed to a heat exchanger 200 via conduit 202 for contact with a hydrogen donor solvent, as described in the first embodiment, which is passed to heat exchanger 200 via conduit 204. Such contact takes place at process conditions as described in the first embodiment, thereby producing a treated petroleum oil. The treated petroleum oil is removed from heat exchanger 200 via conduit 206 and has a TAN which is lower than the TAN of the acidic petroleum oil. Preferably, the TAN of the treated petroleum oil is less than 1.0, more preferably less than 0.7, even more preferably less than 0.5 and most preferably less than 0.1.

The treated petroleum oil is then passed to a separator 208 via conduit 206. Preferably, a fraction is removed from the treated petroleum oil. The fraction is preferably a middle distillate cut of the treated petroleum oil. More preferably, the hydrocarbons of the fraction boil in the range of from about 500° F. to about 900° F., preferably from about 500° F. to about 800° F., and most preferably from 500° F. to 650° F., as determined using ASTM test method D5307-97 (Test Method for Determination of Boiling Range Distribution of Crude Petroleum by Gas Chromatography). The fraction is also preferably substantially free of metal contaminants which can poison hydrogenation catalysts.

The fraction can be passed to a reactor 210 via conduit 212 for contact with a hydrogenation catalyst in the presence of hydrogen, supplied to reactor 210 via conduit 214, and under process conditions sufficient to hydrogenate at least a portion of the hydrocarbons of the fraction. The hydrogenation catalyst useful in the present invention can be any catalyst useful in hydrogenating hydrocarbons. Typical catalysts include, but are not limited to, Co/Mo, and Ni/Mo containing catalysts. The temperature at which the hydrogenation takes place can be in the range of from about 500° F. to about 800° F., preferably from about 550° F. to about 750° F., and most preferably from 600° F. to 700° F.

At least a portion of the hydrogenated fraction can then be passed from reactor 210 to heater 200 via conduits 216, 204 and 202 for utilization as at least a portion of the hydrogen donor solvent.

In addition, light hydrocarbons and/or water can be removed overhead from separator 208 via conduit 218 and sent downstream for further processing. Also, a light petroleum fraction can be removed from separator 208 as a sidedraw via conduit 220 which is located above conduit 206 and below conduit 218. Additionally, a heavy petroleum fraction is removed from separator 208 via conduit 222. The light and heavy fractions in conduits 220 and 222, respectively, are then combined to thereby form a treated petroleum product stream which is passed downstream via conduit 224 for further processing, such as desalting.

Figure 3:
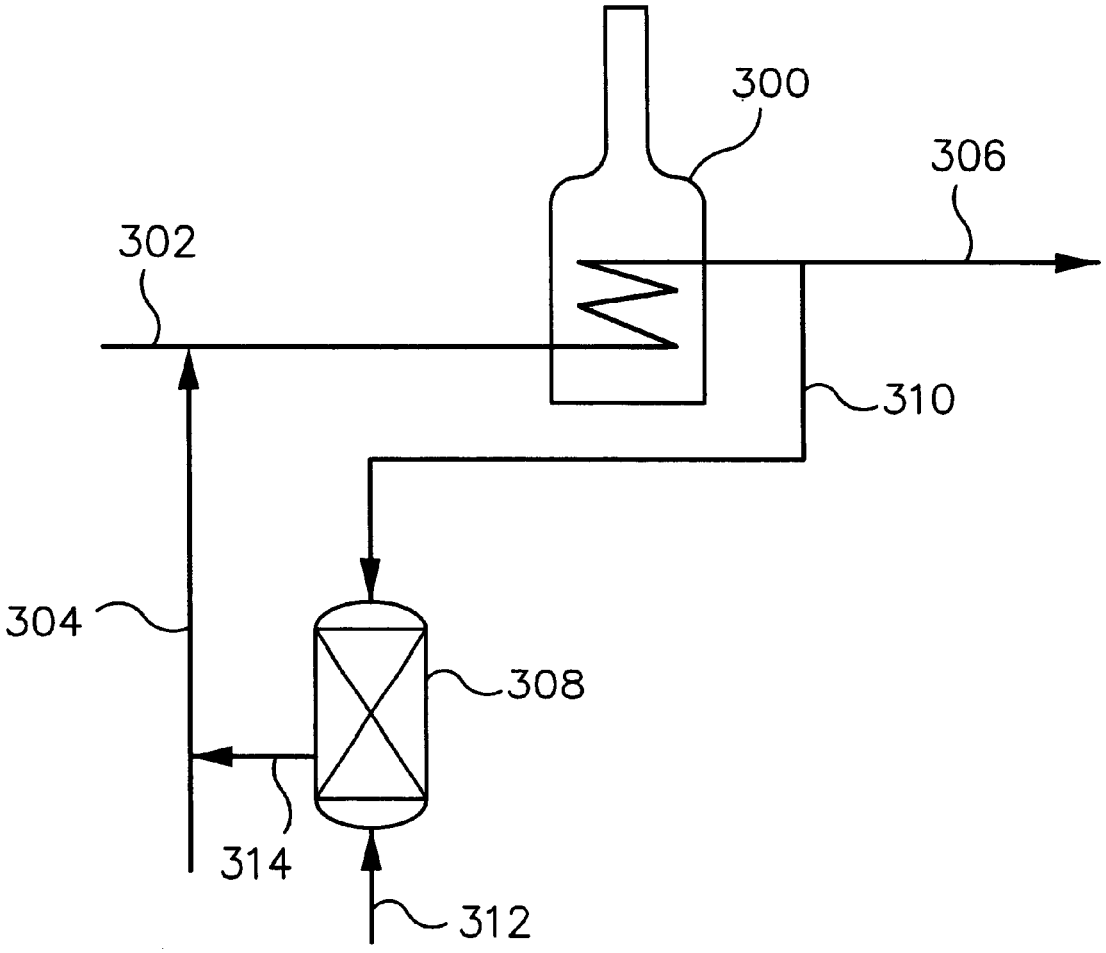
FIG. 3 is a schematic flow diagram presenting an embodiment of the present invention.

In accordance with a third embodiment of the present invention, and referring to FIG. 3, an acidic petroleum oil, as described in the first embodiment, is passed to a heat exchanger 300 via conduit 302 for contact with a hydrogen donor solvent which is passed to heat exchanger 300 via conduit 304. Such contact takes place at process conditions as described in the first embodiment, thereby producing a treated petroleum oil. The treated petroleum oil is removed from heat exchanger 300 via conduit 306 and has a TAN which is lower than the TAN of the acidic petroleum oil. Preferably, the TAN of the treated petroleum oil is less than 1.0, more preferably less than 0.7, even more preferably less than 0.5, and most preferably less than 0.1.

A portion of the treated petroleum oil is passed from conduit 306 to a reactor 308 via conduit 310 for contact with a hydrogenation catalyst in the presence of hydrogen, supplied to reactor 308 via conduit 312, and under process conditions as described in the second embodiment, to hydrogenate at least a portion of the hydrocarbons of the portion of treated petroleum oil, thereby producing a hydrogenated treated petroleum oil. At least a portion of the hydrogenated treated petroleum oil can then be passed from reactor 308 to heater 300 via conduits 314, 304 and 302, for utilization as at least a portion of the hydrogen donor solvent. The portion of treated petroleum oil is preferably a full boiling range portion of the treated petroleum oil. The remaining treated petroleum oil is sent downstream via conduit 306 for further processing, such as desalting and fractionation.

Whereas this invention has been described in terms of the preferred embodiments, reasonable variations and modifications are possible by those skilled in the art. Such modifications are within the scope of the described invention and appended claims.

That which is claimed is:

1. A process for hydrotreating acidic compounds of an acidic petroleum oil which comprises:

contacting an acidic petroleum oil comprising at least one acidic compound with a hydrogen donor solvent at process conditions sufficient to promote hydrogen transfer from said hydrogen donor solvent to said at least one acidic compound of said acidic petroleum oil, thereby producing a treated petroleum oil.

2. A process in accordance with claim 1 wherein said hydrogen donor solvent comprises a hydrocarbon selected from the group consisting of decalin, tetralin, any petroleum oil having hydrogen added thereto, and combinations of any two or more thereof.

3. A process in accordance with claim 1 wherein said acidic petroleum oil is contacted with said hydrogen donor solvent without the presence of a hydrogenation catalyst.

4. A process in accordance with claim 1 wherein said acidic petroleum oil is contacted with said hydrogen donor solvent prior to desalting of said acidic petroleum oil.

5. A process in accordance with claim 1 wherein said process conditions include a temperature which is below the temperature at which significant cooking of said acidic petroleum oil occurs.

6. A process in accordance with claim 1 wherein said process conditions include a temperature in the range of from about 700° F. to about 900° F.

7. A process in accordance with claim 1 wherein said process conditions include a temperature in the range of from about 750° F. to about 850° F.

8. A process in accordance with claim 1 wherein said process conditions include a temperature in the range of from about 775° F. to about 825° F.

9. A process in accordance with claim 1 wherein said at least one acidic compound comprises a naphthenic acid.

10. A process in accordance with claim 9 wherein said naphthenic acid is a carboxylic acid of the formula R—COOH, wherein R comprises in the range of from 1 to 50 carbon atoms.

11. A process in accordance with claim 1 wherein the total acid number (TAN), as determined using ASTM test method D664-95, of said treated petroleum oil is lower than the TAN of said acidic petroleum oil.

12. A process for hydrogenating acidic compounds of an acidic petroleum oil which comprises:

contacting an acidic petroleum oil comprising at least one acidic compound with a hydrogen donor solvent at process conditions sufficient to promote hydrogen transfer from said hydrogen donor solvent to said at least one acidic compound of said acidic petroleum oil, thereby producing a treated petroleum oil;

removing a fraction from said treated petroleum oil;

contacting said fraction with a hydrogenation catalyst in the presence of hydrogen and under process conditions sufficient to hydrogenate at least a portion of the hydrocarbons of said fraction; and utilizing at least a portion of said fraction as at least a portion of said hydrogen donor solvent.

13. A process in accordance with claim 12 wherein said acidic petroleum oil is contacted with said hydrogen donor solvent without the presence of a hydrogenation catalyst.

14. A process in accordance with claim 12 wherein said petroleum oil is contacted with said hydrogen donor solvent prior to desalting of said acidic petroleum oil.

15. A process in accordance with claim 12 wherein said process conditions include a temperature which is below the temperature at which significant coking of said acidic petroleum oil occurs.

16. A process in accordance with claim 12 wherein said process conditions include a temperature in the range of from about 700° F. to about 900° F.

17. A process in accordance with claim 12 wherein said process conditions include a temperature in the range of from about 750° F. to about 850° F.

18. A process in accordance with claim 12 wherein said process conditions include a temperature in the range of from about 775° F. to about 825° F.

19. A process in accordance with claim 12 wherein said at least one acidic compound comprises a naphthenic acid.

20. A process in accordance with claim 19 wherein said naphthenic acid is a carboxylic acid of the formula R—COOH, wherein R comprises in the range of from 1 to 20 carbon atoms.

21. A process in accordance with claim 12 wherein the total acid number (TAN), as determined using ASTM test method D 664-95, of said treated petroleum oil is lower than the TAN of said acidic petroleum oil.

22. A process in accordance with claim 12 wherein the hydrocarbons of said fraction boil in the range of from about 500° F. to about 900° F., as determined using ASTM test method D 5307-97.

23. A process for hydrogenating acidic compounds of an acidic petroleum oil which comprises:

contacting an acidic petroleum oil comprising at least one acidic compound with a hydrogen donor solvent at process conditions sufficient to promote hydrogen transfer from said hydrogen donor solvent to said at least one acidic compound of said acidic petroleum oil, thereby producing a treated petroleum oil;

contacting a portion of said treated petroleum oil with a hydrogenation catalyst in the presence of hydrogen and under process conditions sufficient to hydrogenate at least a portion of the hydrocarbons of said portion of said treated petroleum oil, thereby producing a hydrogenated treated petroleum oil; and utilizing at least a portion of said hydrogenated treated petroleum oil as said hydrogen donor solvent.

24. A process in accordance with claim 23 wherein said acidic petroleum oil is contacted with said hydrogen donor solvent without the presence of a hydrogenation catalyst.

25. A process in accordance with claim 23 wherein said petroleum oil is contacted with said hydrogen donor solvent prior to desalting of said acidic petroleum oil.

26. A process in accordance with claim 23 wherein said process conditions include a temperature which is below the temperature at which significant coking of said acidic petroleum oil occurs.

27. A process in accordance with claim 23 wherein said process conditions include a temperature in the range of from about 700° F. to about 900° F.

28. A process in accordance with claim 23 wherein said process conditions include a temperature in the range of from about 750° F. to about 850° F.

29. A process in accordance with claim 23 wherein said process conditions include a temperature in the range of from about 795° F. to about 825° F.

30. A process in accordance with claim 23 wherein said at least one acidic compound comprises a naphthenic acid.

31. A process in accordance with claim 30 wherein said naphthenic acid is a carboxylic acid of the formula R—COOH, wherein R can be any alkyl group having in the range of from 1 to 20 carbon atoms per molecule.

32. A process in accordance with claim 23 wherein the total acid number (TAN), as determined using ASTM test method D664-95, of said treated petroleum oil is lower than the TAN of said acidic petroleum oil.

33. A process in accordance with claim 23 wherein said portion of said treated petroleum oil is at least partially desalted and/or at least partially dewatered prior to contact with said hydrogenation catalyst.

* * * * *

UNITED STATES PATENT AND TRADEMARK OFFICE

CERTIFICATE OF CORRECTION

PATENT NO. : 6,673,238 B2
DATED : January 6, 2004
INVENTOR(S) : Bruce W. Gerhold et al.

It is certified that error appears in the above-identified patent and that said Letters Patent is hereby corrected as shown below:

Column 5,
Line 3, please delete “cooking” and insert -- coking --.

Signed and Sealed this

Thirtieth Day of March, 2004

JON W. DUDAS
*Acting Director of the United States Patent and Trademark Office*